US006352185B1

(12) United States Patent
Arabnia

(10) Patent No.: US 6,352,185 B1
(45) Date of Patent: Mar. 5, 2002

(54) METERING SPOUT-COVER ASSEMBLY FOR PAINT VESSELS AND THE LIKE

(76) Inventor: Ali Reza Arabnia, Via Sant Andrea, 27, 20052 Monza (Milano) (IT)

( * ) Notice: Subject to any disclaimer, the term of this patent is extended or adjusted under 35 U.S.C. 154(b) by 0 days.

(21) Appl. No.: 09/665,458

(22) Filed: Sep. 19, 2000

(30) Foreign Application Priority Data

Apr. 6, 2000 (IT) ..... MI200A743

(51) Int. Cl.[7] ..... B65D 5/72

(52) U.S. Cl. ..... 222/473; 222/570

(58) Field of Search ..... 222/472–474, 222/568, 570, 469

(56) References Cited

U.S. PATENT DOCUMENTS

| | | | | | |
|---|---|---|---|---|---|
| 2,154,581 | A | * | 4/1939 | Pershall | 222/473 |
| 2,676,472 | A | * | 4/1954 | Paddock | 222/473 |
| 4,921,146 | A | * | 5/1990 | Salzmann | 222/472 |
| 5,267,675 | A | * | 12/1993 | Cane | 222/568 |

* cited by examiner

*Primary Examiner*—Philippe Derakshani
(74) *Attorney, Agent, or Firm*—Hedman & Costigan, P.C.

(57) ABSTRACT

A cover provided with a metering spout, for paint vessels and the like, comprises a cover body, including a metering or delivering spout, thereon a guillotine type of closure elements operates, the cover further including an adapter ring, removably coupled to the outer surface of the vessel and defining, on the outside thereof, a thread for coupling the cover body.

6 Claims, 5 Drawing Sheets

1
6
3
5
4
22
2
13
11
12
20
20
10
31
11
15
14
8

METERING SPOUT-COVER ASSEMBLY FOR PAINT VESSELS AND THE LIKE

BACKGROUND OF THE INVENTION

The present invention relates to a metering spout-cover assembly, specifically designed for paint vessels and the like.

As is known, metering spout cover to be applied to paint vessels and the like by clamping systems usually engaged with an edge or rim flange, are already known.

The edge flange, in particular, is arranged at the top face of the vessel and defines the cover application region, for pressure closing the vessel.

The above mentioned vessels, however, are affected by several drawbacks, due to the fact that the mentioned edge flanges can have different sizes, and, because of this, the engagement region width being undesirably modified.

Moreover, it is difficult to provide a perfect sealing, since the locking region is not coherently defined and/or is limited to few points.

SUMMARY OF THE INVENTION

Accordingly, the aim of the present invention is to overcome the above mentioned drawbacks, by providing a metering spout-cover assembly, specifically designed for paint vessels and the like, allowing to assure a perfectly sealed coupling between the cover and vessel, independently from the specific configuration of the vessel.

Within the scope of the above mentioned aim, a main object of the present invention is to provide such a metering spout-cover assembly which can be firmly applied to the vessel without causing localized deformations or damages to the vessel, thereby always providing a very good sealing, independently from the specific sizes of the vessel edge flange.

In this connection it should be pointed out that a damage to a prior metering spout-cover assembly would cause a removal of the vessel protective coating, with a consequent formation of rusting and spoiling of the paints or products held in said vessel.

Yet another object of the present invention is to provide such a metering spout-cover assembly which, owing to its peculiar constructional features, is very reliable and safe in operation.

Yet another object of the present invention is to provide such a metering spout-cover assembly which can be easily made starting from easily available elements and materials and which, moreover, is very competitive from a mere economic standpoint.

According to one aspect of the present invention, the above mentioned aim and objects, as well as yet other objects, which will become more apparent hereinafter, are achieved by a metering spout-cover assembly, for paint vessels and the like, comprising a cover body including a metering spout, affected by a guillotine type of closure element, characterized in that said metering spout-cover assembly comprises an adapter ring, which can be removably coupled to the outer surface of a said vessel and the like, and defining, on an outside thereof, a thread for coupling the cover body.

BRIEF DESCRIPTION OF THE DRAWINGS

Further characteristics and advantages of the present invention will become more apparent hereinafter from the following detailed disclosure of a preferred, though not exclusive, embodiment of a metering spout-cover assembly, specifically designed for paint vessels and the like, being shown, by way of an indicative, but not limitative, example, in the figures of the accompanying drawings, where.

DESCRIPTION OF THE PREFERRED EMBODIMENTS

Figure 1:
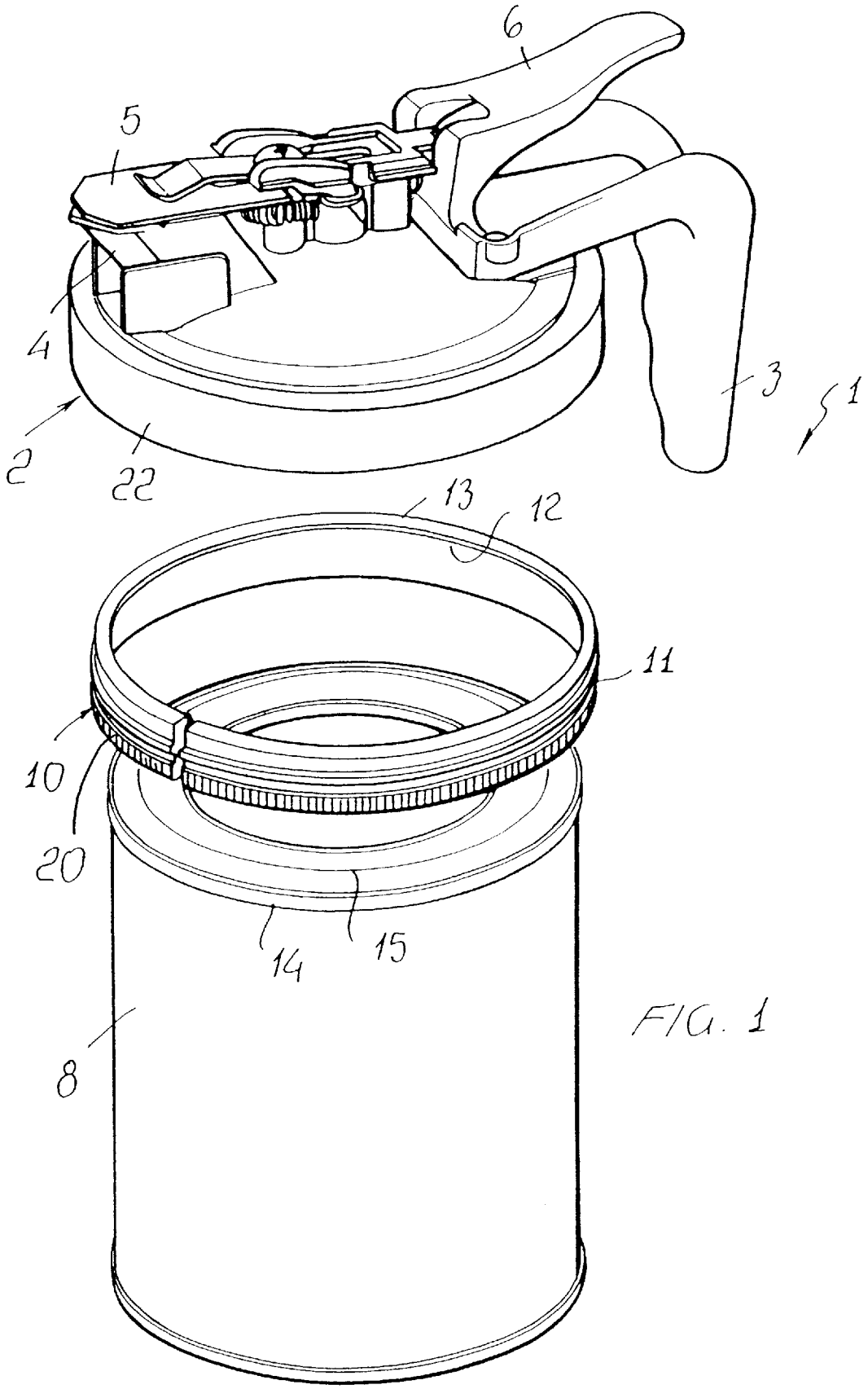
FIG. 1 is a schematic exploded perspective view illustrating the cover and related adapter ring.
Figure 2:
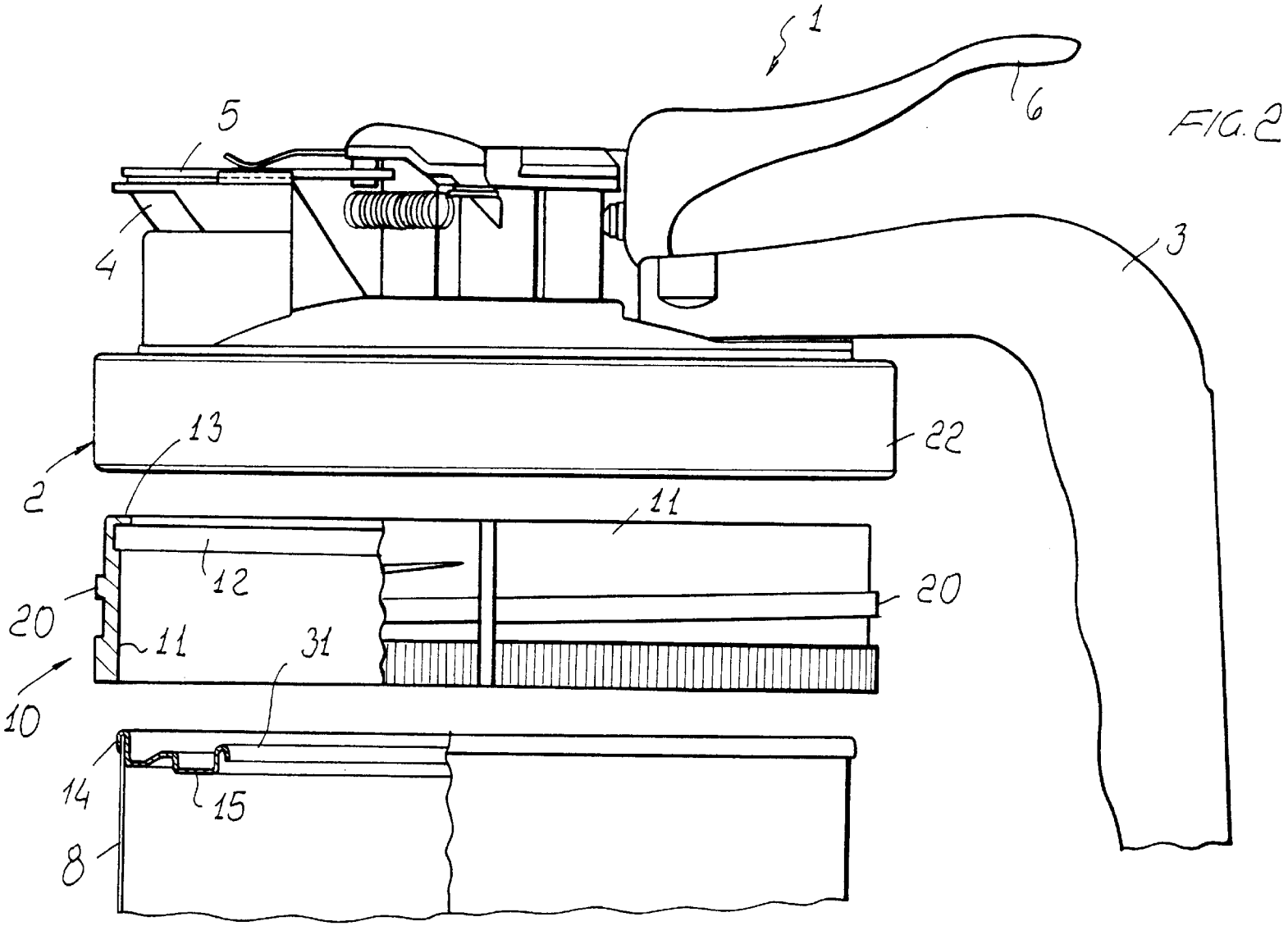
FIG. 2 is an elevation, and partially broken-away, view illustrating the cover, seen in exploded form, with respect to the adapter and vessel.
Figure 3:
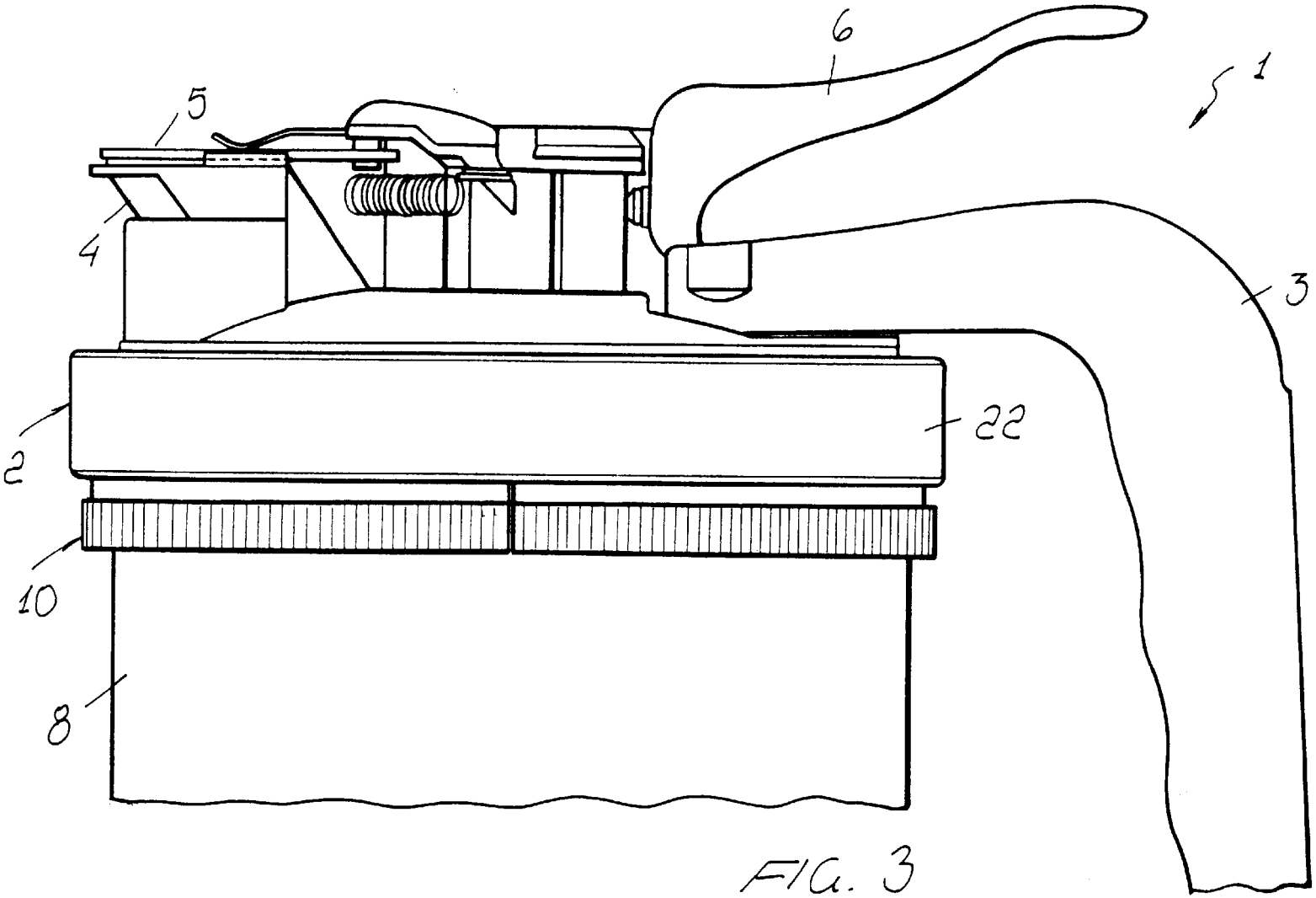
FIG. 3 illustrates that same cover applied to a vessel.
Figure 4:
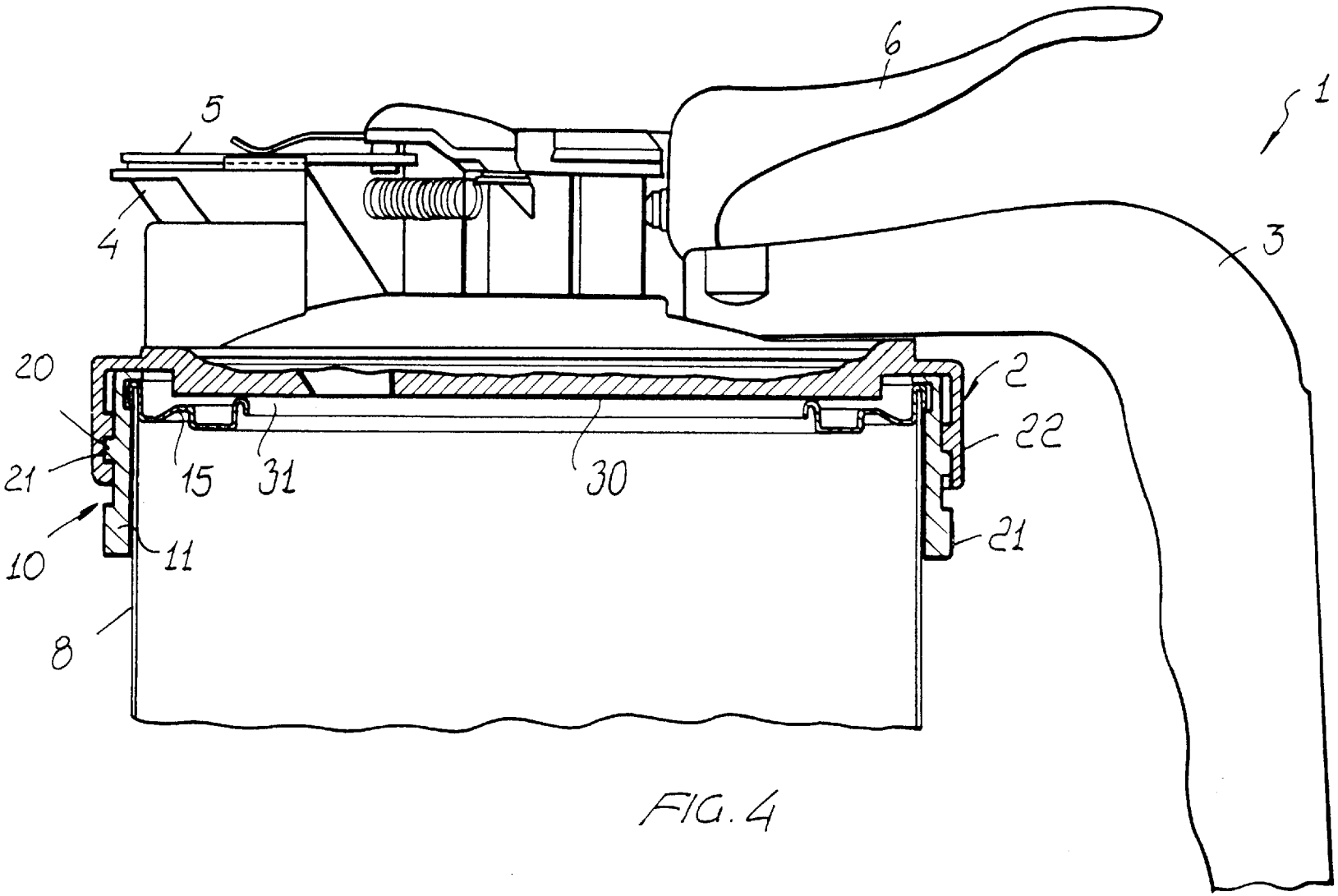
FIG. 4 is a cross-sectional view illustrating the cover applied to a vessel having a wide flange arrangement.
Figure 5:
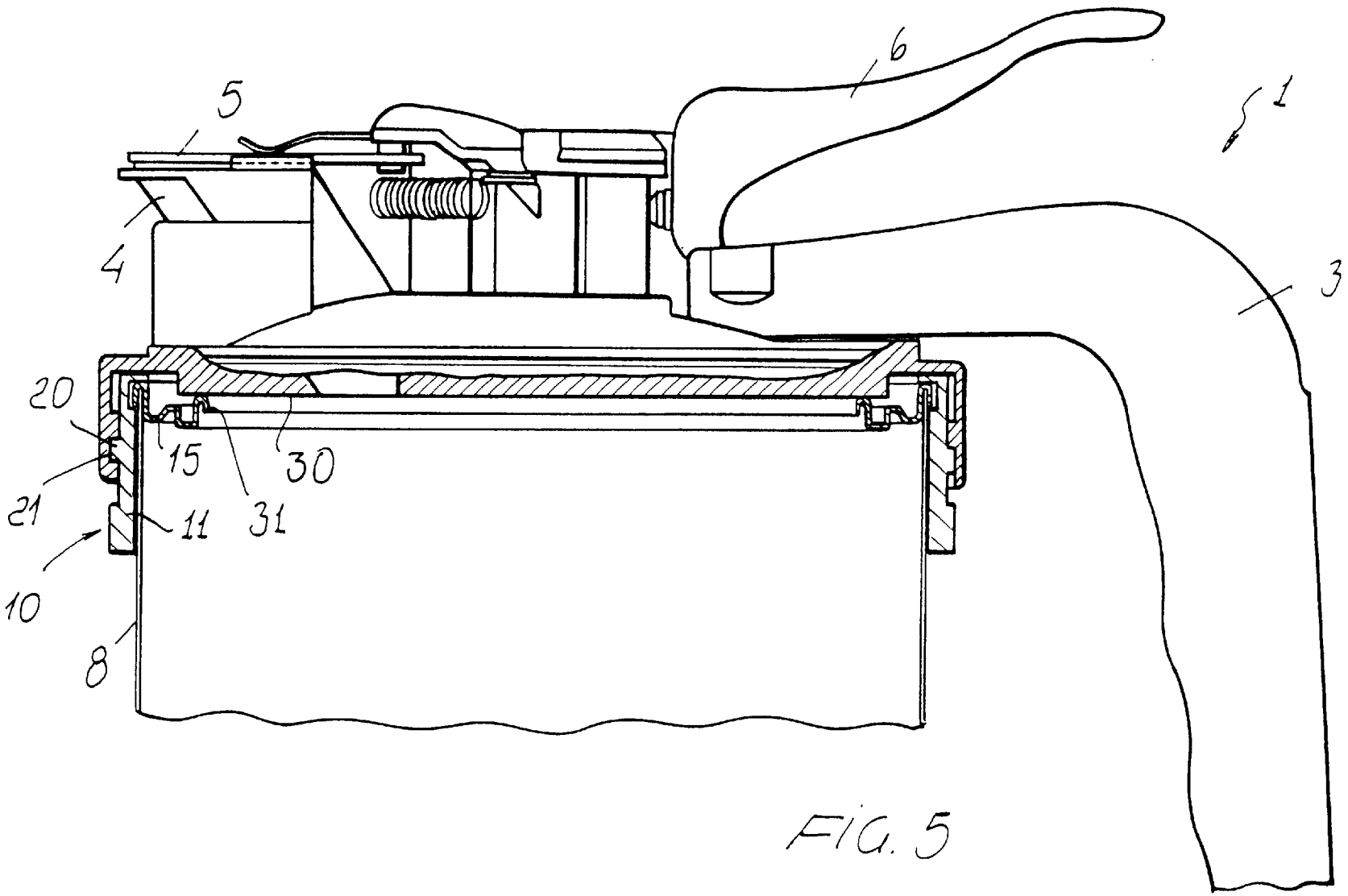
FIG. 5 is a further cross-sectional view showing the cover applied to a vessel including a narrow flange arrangement.

With reference to the number reference of the above mentioned figures, the delivery spout-cover assembly, specifically designed for paint vessels and the like, according to the present invention, which has been generally indicated by the reference number 1, comprises a cover body 2, which is preferably provided with a gripping handle 3, and defining a conventional metering or delivering spout 4, thereon a guillotine type of closure element 5, controlled by a lever 6, can slide.

The main feature of the invention is that, in order to connect the cover to the vessel 8, an adapter ring, generally indicated by the reference number 10, is provided, said adapter ring comprising a band body 11, having a circular extension interrupted at a point of the surface thereof.

Said body is provided, at the top edge thereof, with a recess 12, delimited, at the top, by an upturned edge 13.

The recess 12 allows the clamping region 14 of the flange 15 to the vessel 8 to be housed therein.

The adapter ring 10, in particular can be made with different radial thicknesses, thereby easily fitting to vessels of slightly different diameters.

On its outer surface, the adapter ring is provided with a male thread 20, adapted for engaging with a female thread 21, defined inside the bottom mantle 22 of the cover body 2.

Thus, it is possible to firmly clamp the cover on the vessel, since, at the threading step, an axial effort between ring and cover occurs and, then, occurring a radial shrinking of the band adapter ring.

A further main feature is that the cover body 2 defines, at the bottom portion thereof, a central flat portion 30 sealed against turned central edge 31 defined by the flange arrangement.

The provision of said flat central portion 30 provides a very good sealing independently from the flange arrangement size, since a broad contact region providing a perfect sealing is thereby made.

Thus, the adapter ring will provide an optimum clamping, without deforming or damaging the surface of the vessel 8.

In this connection it should be moreover pointed out that, in a case of a plastic material vessel, including an outward turned edge, it would be possible to provide an adapter ring free of any inward turned edge 13, for engaging from the bottom of the vessel and in abutment against said outward turned edge.

From the above disclosure it should be apparent that the invention fully achieves the intended aim and objects.

In particular, the fact is to be pointed out that a cover has been provided which can be firmly applied to a lot of different vessels, independently from their size variations, to provide in all conditions a very accurate clamping and sealing.

The invention, as discloses, is susceptible to several modifications and variations, all of which will com within the inventive idea scope.

Moreover, all of the constructional details can be replaced by other technically equivalent elements.

In practicing the invention, the used materials, as well as the contingent size and shapes, can be any, depending on requirements.

What is claimed is:

1. A metering spout-cover assembly for paint vessels, comprising a cover body including a metering spout, affected by a guillotine type of closure element, wherein said metering spout-cover assembly comprises an adapter ring, which can be removably coupled to an outer surface of a said vessel, said adapter ring having an outer male thread for coupling said adapter ring to said cover body.

2. A metering spout-cover assembly, according to claim 1, wherein said cover body defines, at its bottom face, a flat central portion, adapted to seal against an inner turned edge of a flange arrangement of said vessel.

3. A metering spout-cover assembly, according to claim 1, wherein said adapter ring has a band arrangement and is interrupted at a point.

4. A metering sprout-cover assembly, according to claim 1, wherein said adapter ring is provided, at an edge thereof, with a recess delimited by a top inward turned edge, said recess removably engaging therein a clamping region of said vessel and flange arrangement.

5. A metering spout-cover assembly, according to claim 1, wherein said adapter ring has a variable thickness.

6. A metering spout-cover assembly, according to claims, wherein said cover body is provided with a mantle defining a female thread for engaging with said outer male thread of said adapter ring to provide a coupling component between a turned central flat portion defined by said bottom face of said cover body.

* * * * *